United States Patent [19]

Smith

[11] 4,009,705

[45] Mar. 1, 1977

[54] VENTING SYSTEM FOR A GAS-FIRED HEATING PLANT

[75] Inventor: Donald L. Smith, Salem, Ill.

[73] Assignee: Thrifty-Vent, Inc., Salem, Ill.

[22] Filed: May 23, 1975

[21] Appl. No.: 580,133

Related U.S. Application Data

[63] Continuation-in-part of Ser. No. 549,059, Feb. 11, 1975, abandoned, which is a continuation-in-part of Ser. No. 442,334, Feb. 4, 1974, abandoned.

[52] U.S. Cl. ..... 126/307 A; 126/312; 98/48; 431/20

[51] Int. Cl.[2] ..... F23J 11/02

[58] Field of Search ..... 126/307 R, 307 A, 312; 110/147, 162; 98/48, 46, 58, 66 R; 431/20

[56] References Cited

UNITED STATES PATENTS

| | | | |
|---|---|---|---|
| 886,391 | 5/1908 | Moore | 126/307 A |
| 1,837,581 | 12/1931 | Peterson | 126/312 |
| 1,840,628 | 1/1932 | Howle | 126/307 A |
| 2,002,020 | 5/1935 | Nyborg | 126/312 |
| 2,486,780 | 11/1949 | Fenberg | 126/307 A |
| 2,698,140 | 12/1954 | Buehler | 431/20 |
| 2,937,697 | 5/1960 | Johnston | 431/20 |

*Primary Examiner*—Ronald C. Capossela
*Attorney, Agent, or Firm*—Edward F. Connors

[57] ABSTRACT

A venting system for a warm-air furnace, gasfired boiler or the like heating plant has an open bottom diverter box which is arranged horizontally externally of the heating plant substantially at the level of the top thereof. The top wall of the diverter box at one end section thereof is connected by a vertically upstanding U-shaped, internally unobstructed, ducting to the top of the combustion chamber of the heating plant so that fumes flow therethrough into such combustion chamber end section of the box while the top wall of the diverter box at the other end section is connected by a vertically upstanding, internally unobstructed, piping to the flue.

The open bottom of the diverter box is in constant free communication with the air well above the base of the heating plant and the oxygen entering the open bottom establishes a cold pressure head to lock-in the generated heat in the combustion chamber while permitting only clean fumes to pass across the upper portions of the end sections of the diverter box to the flue and while preventing down drafts or blocked flues from interferring with the proper operation of the heating plant.

A safety limit switch is housed in the combustion chamber end section of the diverter box and is activated by a rise in temperature of the fumes in the instance of a blocked flue, for example, to act through the thermostat circuit and close the gas valve to shut off gas flow to the burners of the heating plant. A barrier plate is mounted in the box in protective relation with the switch to prevent any cold down drafts from coming into contact therewith and neutralizing its performance.

10 Claims, 3 Drawing Figures

VENTING SYSTEM FOR A GAS-FIRED HEATING PLANT

The present application is a continuation-in-part of application Ser. No. 549,059, filed Feb. 11, 1975 (now abandoned) which is a continuation-in-part of Ser. No. 442,334 field Feb. 4, 1974 now abandoned.

BACKGROUND OF THE INVENTION

1. Field of the Invention

The present invention generally appertains to new and novel improvements in warm-air furnaces, boilers or the like gas-fired heating plants, and especially relates to a new and novel venting system for use with such heating plants.

2. State of the Art

Various and sundry venting systems for warm-air furnaces and the like heating plants are known in the art. All of such known systems function to carry off the fumes or products of combustion, which contain carbon monoxide, from the flue opening in the gas-fired furnace to the chimney flue. Most venting systems incorporate a back-draft diverter which is built adjacent to the combustion chamber of the furnace and within the jacket of the furnace and which functions to prevent a back draft from blowing out the pilot light in the combustion chamber.

But, in such conventionally vented heating installations, the gravity of the heat in the top of the boiler or furnace constantly allows the heated air to rise out of the chimney flue and to be replaced through the fresh air inlet by cool air, thus cooling off the combustion chamber of the boiler or furnace. Thus, conventional venting systems allow from one-quarter to one-half loss of heat which escapes by gravity of way of the chimney.

Attempts have been made, by way of draft hoods or regulators, to prevent the occurrence of down drafts through the chimney into the furnace. But such draft hoods or regulators also tend to reduce the temperature within the furnace chamber. The heat within the furnace chamber is drawn off or allowed to escape through the flue or chimney and, consequently, more combustion of fuel is required to raise the temperature within the furnace chamber.

One example of such a type of draft hood or regulator is disclosed in U.S. Pat. No. 2,165,811 issued to Peters on July 11, 1939. In such patented arrangement, the furnace chamber is connected to the chimney by means of a smoke pipe which extends upwardly from the furnace chamber and then horizontally in line with a connection into the chimney or into the flue thereof. The draft hood or draft regulator comprises a pipe member that connects the smoke pipe with the chimney connection and has a center portion provided with a baffle that extends downwardly into a vertical pipe which is mounted on the floor of the furnace room. Such pipe has a plurality of openings provided in its lower end portion.

In operation, the combustion products pass through the smoke pipe and then downwardly around the lower end of the baffle plate and then upwardly to the smoke pipe. In the event of a sudden draft, air is intended to be drawn into the vertical pipe through the openings in the lower end thereof while the baffle plate is intended to shield the burner and the pilot thereof from the draft.

In such patented hood or regulator arrangement, the hot air comes straight out of the furnace on a horizontal plane and escapes to the chimney or flue therein. In this respect, there is a cold air pressure within the vertical floor pipe that reaches to the level of the baffle with the draft hood and thus allows most of the hot air to escape up the flue.

Also such back draft diverter system performs little or no function of retaining the heat inside the furnace chamber once the burner has raised it. The stack or chimney temperature would be extremely high due to the escaping heat, slightly higher than the limit control setting of the furnace. The patented system does not hold heat in the furnace and cannot cut the fume temperature.

Such arrangement would never pass the safety standards of 400 parts, per million, of carbon dioxide, or less, content in the fumes as called for in Test Z 223.1 of the American National Standards Institute Inc. Such test is conducted with the flue blocked and with 106.25% of the normal gas pressure on the burner.

The drawing off of heat or the escaping thereof out the flue or chimney poses a serious problem of waste and also constitutes a source of air pollution.

Other types of venting systems, such as those disclosed in U.S. Pat. No. 931,824 to Weidenback et al and U.S. Pat. No. 1,655,858 to Donovan involve the utilization of check dampers.

Not one of such known venting systems deals with the problem of conservation of fuel while realizing a safe installation and operation is warm-air furnaces and gas-fired boilers. In other words, the two-folded problem of savings and safety and also, the task of reducing pollution.

In conventional methods of venting a gas-fired furnace, the gravity of the heat in the top of the furnace always permits the heat to rise out of the chimney flue and be replaced in the fresh air inlet at the main burners by cold air. This cools off the furnace chamber.

Furthermore, in conventional methods of venting, internal baffle means are utilized as back-draft diverters but none of these serve to form a heat lock within the combustion chamber so as to hold high temperature heat within the combustion chamber until the heat exchanger gives the heat off to the rooms serviced by the furnace.

And, in addition, none reduce the flue vent pipe temperature. But overheated vent pipes cause most, if not all, flue fires.

Also, known venting systems do not take into account flue stoppages, such as those caused by bird nests built in the chimney flue. Such stoppages block up the flue and, consequently, the lethal carbon monoxide fumes are pushed out into the building.

Finally, conventional venting systems must meet the standards set by the American National Standards Institute For Fire Protection and the American Gas Association and be adaptable for use in the limited furnace space usually found in modern home installations.

SUMMARY OF THE INVENTION

Having in mind the foregoing, an important object of the present invention is to provide a venting system for a gas-fired furnace or boiler whereby high savings in gas consumption can be realized, back-drafts to the pilot light can be prevented, flue pipe temperatures can be reduced and dangers fraught with flue stoppages can be eliminated.

An important object of the present invention is to provide an extremely economical, simple but highly effective venting system for a gas-fired heating plant, which system will serve to divert back drafts and to lock-in the heat inside the combustion chamber of the heating plant.

An equally important object of the present invention is to provide a venting system for a gas-fired furnace whereby over 90% of the generated heat will be forcibly held within the combustion chamber for distribution to the rooms of a building instead of being drawn off or allowed to escape out the flue or chimney as waste or pollution with the venting system, at the same time, preventing down drafts from reaching the pilot.

A further important object of the present invention is to provide a venting system that can be used with modern warm-air furnaces having factory installed internal diverters or gas-fired boilers having factory installed draft hoods.

A further important object of the present invention is to provide a venting system that can meet the safety standards set by regulatory agencies and associations.

Furthermore, another object of the present invention is to provide a venting system that cools the fumes emanating from the combustion chamber so as to reduce the temperature of the vent pipe and thereby prevent flue fires.

As a further safety factory, another object of the present invention is to provide a safety switch which will respond to higher than normal temperatures of the fumes, such as occurring in the instance of blocked flues, to shut off the main burners.

Another important object of the present invention is to provide a venting system for a gas-fired warm-air furnace which by radiation heat transfer can heat the furnace room or entire basement so as to eliminate outlets in the warm-air supply ducting from the furnace within the basement area.

DESCRIPTION OF THE PREFERRED EMBODIMENT

Figure 2:
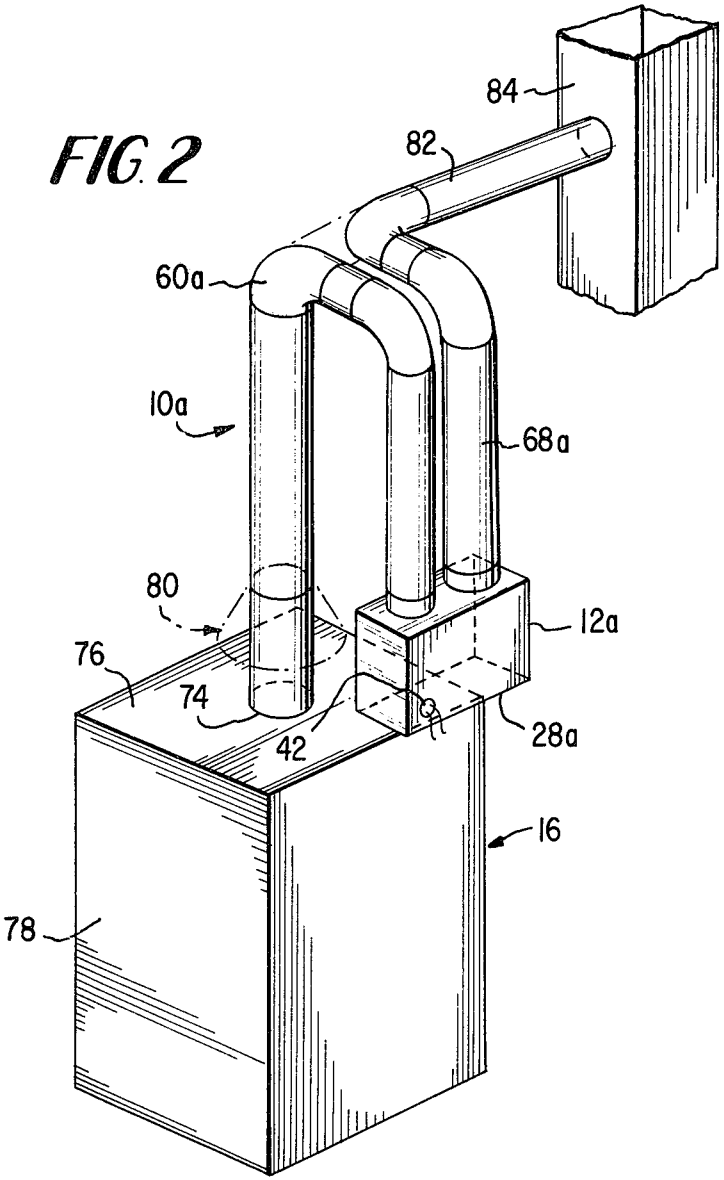
FIG. 2 is a perspective view of the venting system of the present invention installed on a conventional gas-fired boiler.
Figure 3:
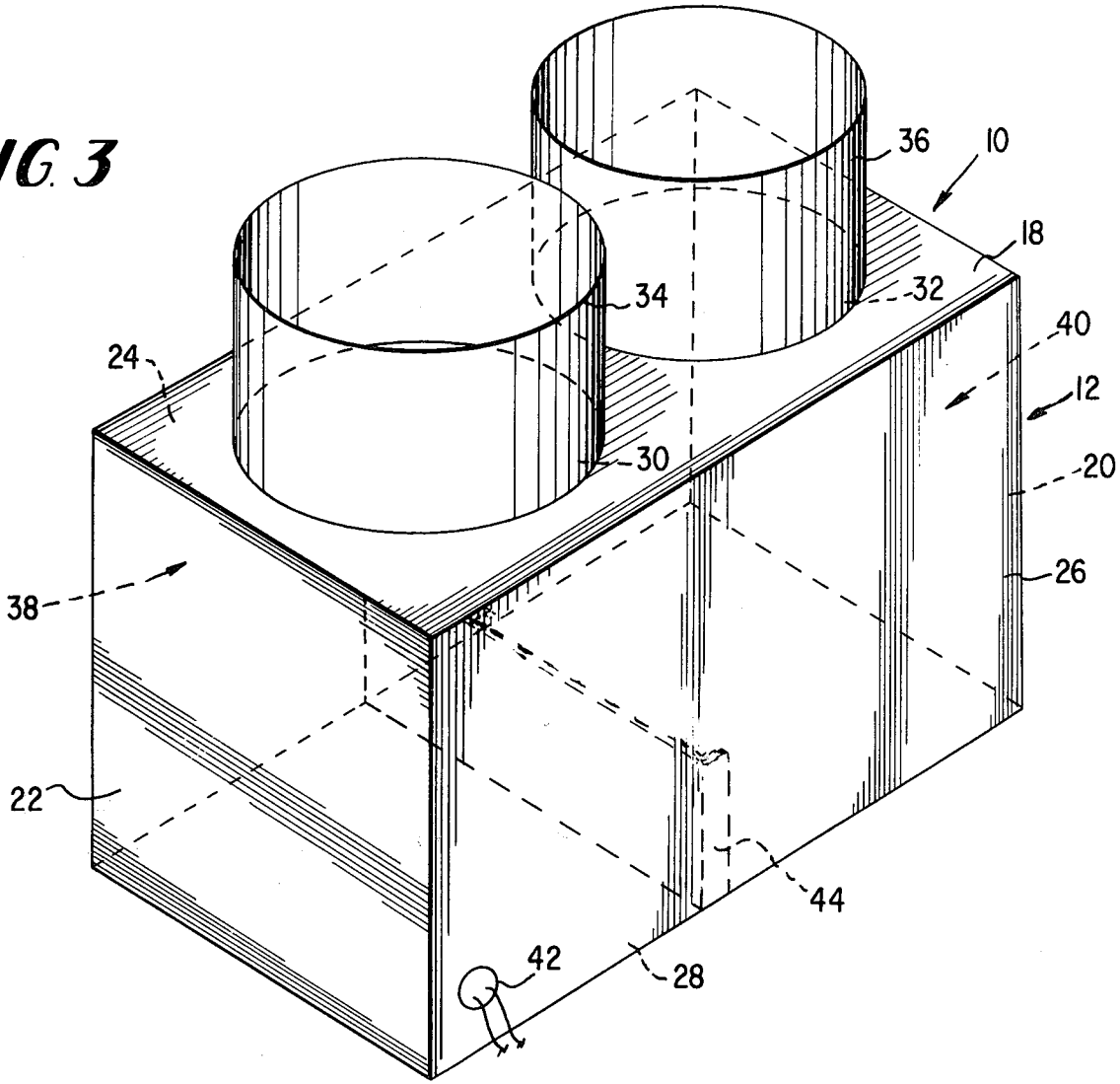
FIG. 3 is a perspective view of the diverter box, per se, of the venting system of the present invention.

Referring now more particularly to the accompanying drawings and initially to FIG. 3, the venting system 10 includes a diverter box 12 which is fabricated from 24 gauge galvinized iron, for example. Such material is merely exemplary. The diverter box in use will be arranged vertically and will be disposed horizontally at substantially the level of the top of the conventional warm-air furnace 14 of FIG. 1 or the gas-fired boiler 16 of FIG. 2.

The diverter box is substantially rectangular and is composed of a top wall 18, opposing vertical end walls 20 and 22 and opposing vertical side walls 24 and 26. The bottom 28 of the box is completely open.

The top wall 18 is formed adjacent the end walls with openings 30 and 32 which are circumscribed by upstanding collars 34 and 36. The collar 34 and its attendant opening 30 in the top wall of the diverter box define the inlet for products of combustion or fumes from the furnace 14 or the boiler 16 while the collar 36 and its associated opening 32 in the top wall constitute an outlet leading from the diverter box to the usual chimney flue.

Thus, the diverter box is, in effect, divided into two end sections 38 and 40 with the end section 38 being the combustion chamber section communicating with the combustion chamber of the furnace or boiler and the end section 40 being the flue section communicating with the chimney flue.

The combustion end section 38 is provided with a safety spill switch 42 which is tied into one leg of the conventional thermostat for the heating plants and which is activated, as will be described, to shut off the thermostat circuit which controls the gas flow to the main burner through the gas valve. As is well known, the thermostat works through a high-limit control, a safety-pilot switch and then to the gas valve. When the gas valve is open, gas flows to the main burner where it is ignited by the pilot.

The safety switch operates under high temperature of fumes or combustion products to prevent lethal carbon monoxide fumes from entering the building should the flue be blocked, as will be described in connection with the installations of FIGS. 1 and 2. To protect the switch from being disinfluenced by cold air air drafts, such as winds coming from through the opening 32, a shield or barrier plate 44 is arranged transversely between the side walls 24 and 26 at the open bottom 28 and transversely in between the openings 30 and 32 in the top wall 18. The shield prevents cold air from contacting the safety switch and preventing it from functioning.

Figure 1:
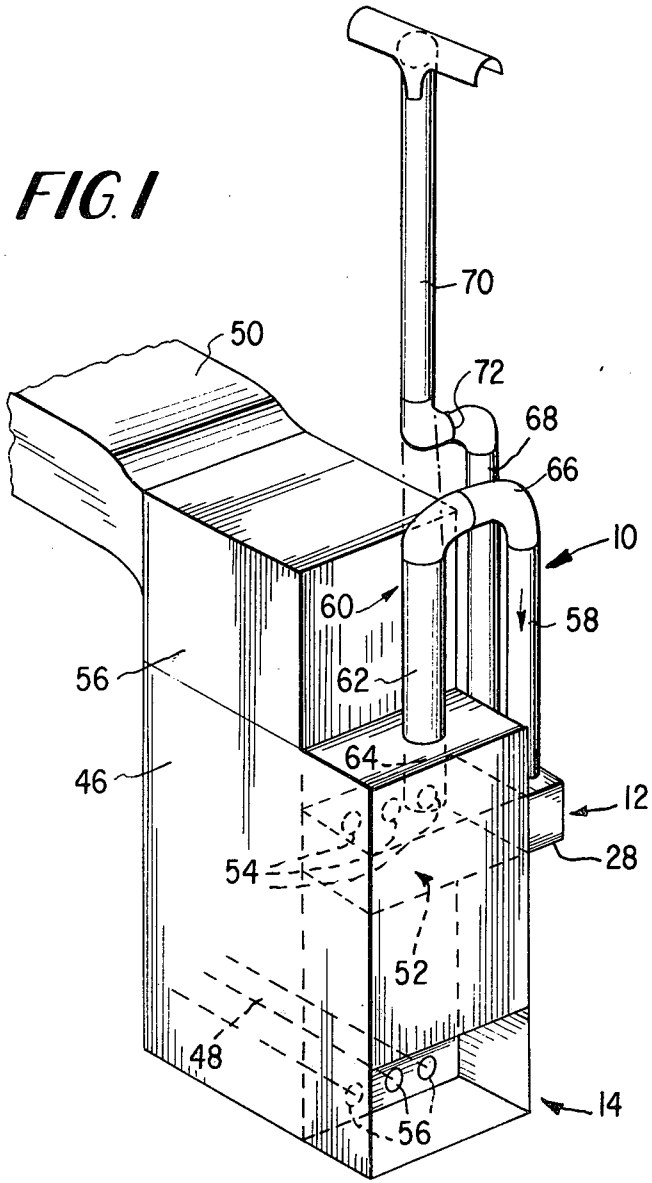
FIG. 1 is a perspective view of the venting system of the present invention installed on a typical warm-air furnace.

Having reference to FIG. 1, the warm air furnace 14 is of modern conventional construction and includes a jacket 46 containing a burner compartment 48, composed of the pilot and main burners, a heat exchanger, a blower compartment and suitable openings in the jacket for supply ducts 50 and return ducts. Such a furnace has a built-in back-draft diverter 52 shown in dotted lines in FIG. 1. The factory diverter box 52 has an open bottom and flue outlets 54 open into the box. Usually, there is a flue outlet for each main burner so, if there are three burners 56, there are three flue outlets 54, as exemplarily shown in FIG. 1.

The first step that is taken in the installation of the venting system 10 of the present invention is to seal off tight the open bottom of the factory diverter 52 so that it becomes a collection box. Then, the diverter box 12 of the present invention is attached to the outside of the furnace jacket 46, as shown in FIG. 1. The open bottom diverter box 12 is positioned so that its open bottom 28 is at the same elevation as the factory diverter 52. It is important that the diverter box 12 be positioned substantially at the level of the top 56 of the jacket 46 or, otherwise stated, that it have its open bottom 28 lying in a horizontal plane above or, at least, in the same plane in which the bottom of the factory diverter lies. This is important so that sufficient oxygen enters the diverter boxy 12 through the open bottom. The proper amount of entering oxygen will keep the carbon monoxide in the fumes from getting dirty and will create the heat lock in the combustion chamber with the fumes being clean and the fumes in the diverter box becoming cooler and flowing out through the outlet 32 to the chimney flue, which is thereby cool. Thus, the generated heat is retained inside the combustion chamber of the furnace until the heat exchanger gives off the heat through the warm air supply duct to the rooms in the building.

In the installation of the diverter box 12, the inlet 30 has its collar 34 attached to the vertically depending leg section 58 of an internally unobstructed U-shaped piping 60 which has its other leg section 62 attached to a flue opening 64 in the jacket 46. The leg sections 58 and 62 are connected at their upper ends above the furnace 14 and the diverter box 12 by an internally unobstructed elbow 66 of the same internal diameter as the leg sections. The flue opening 64 is formed in the jacket into the top of the sealed factory diverter 52 as a substitute for the original flue vent which is removed.

The outlet 32 has its collar 36 attached to a vertically upstanding pipe 68 which is, in turn, connected to the chimney flue 70, usually by an elbow connector 72.

In practical installations all of the pipe is the same internal diameter, such as 5, 6, or 7 inches. With a pipe size of 6 inches, the diverter box would be of dimensions 7 × 14 × 10 inches deep, as in the box 12 of FIG. 3. A 5 inch pipe would take a 6 × 12 × 10 inches deep. A 7 inch pipe would require a 8 × 16 × 10 inches deep.

The venting system 10*a* operatively associated with the conventional gas boiler 16 of FIG. 2 is the structural and functional equivalent of the venting system 10 for the furnace 14 of FIG. 1.

As shown in FIG. 2, the diverter box 12*a* is attached by the U-shaped piping 60*a* to a flue outlet 74 formed fresh in the top 76 of the jacket 78 for the gas-fired boiler 16. The original factory draft hood 80 (shown in dotted lines) is discarded. The diverter box 12A is fixedly placed by suitable attachment to the jacket 78 so that its open bottom 28*a* is at substantially the same elevation as the factory diverter opening for the original draft hood. The diverter box 12*a* is attached by a vertical pipe 68*a* and associated piping 82 to the chimney flue 84.

In either of the installations of FIGS. 1 and 2, which are exemplary showings of the venting system in operation with a warm-air furnace 14 or a boiler 16, the diverter box is fastened to the jacket of such furnace or boiler by brackets. And it is arranged in a horizontal position with the open bottom 28 or 28*a* facing downwardly. The placement of the diverter box at the height well above the base of the heating plant will ensure that sufficient oxygen enters the diverter box so as to establish the heat lock in the combustion chamber of the heating plants and to ensure that the fumes are cleaner. The lower the diverter box is placed then the dirtier the fumes will be as they pass from the chimney flue. Also, the hotter will be such issuing fumes.

In a sealed controlled environmental furnace, a test was made with and without the venting system of this invention.

The diverter box functions as a condensation trap to prevent condensation from getting back in the furnace. And with the cooled vent it is impossible for vent fires to occur.

It can be appreciated that the diverter box because of its small size and compact shape can be installed in a minimum of space.

Of course, while the preferred forms of the present invention have been described herein and shown in the attached drawings, it is to be understood that such is merely exemplary in nature and the scope of the invention is defined by the appended claims.

What is claimed is:

1. In combination with a gas-fired heating lant having a base, an upper portion and having a combustion chamber provided with a flue outlet provided in the upper portion for the outlet passage of combustion gases to be conveyed to a chimney flue for the heating plant: a venting system for the combustion chamber comprising a first piping connected to the flue outlet, a second piping connected to the chimney flue, a diverter box vertically arranged relative to the heating plant exteriorly thereof and having an upper portion and a lower portion, said diverter box being connected to and intercommunicating both of said pipings at its upper portion and having a bottom provided with a substantial opening disposed well above the base of the heating plant at the upper portion of the heating plant with said opening being in constant free communication with the atmospheric air surrounding the heating plant which air enters the diverter box through the opening in the bottom as cold air to establish a cold air pressure head below the first piping and establish a heat lock to prevent the flow of heated air from the combustion chamber outlet of the heating plant and also to prevent down drafts from the chimney flue attempting to pass down through the second piping from reaching the combustion chamber of the heating plant.

2. The invention of claim 1 wherein said diverter box has a first end section communicated with the first piping and a second end section communicated with the second piping with cross flow of fumes being present therebetween at the upper portions thereof and a safety limit switch housed in the first section.

3. The invention of claim 2 wherein said switch is connected to the thermostat for the heating plant to control thereby the flow of gas to the main burners and is activated by fumes from the outlet for the combustion chamber passing into the first end section through the first piping to shut off the fuel supply line.

4. The invention of claim 3 wherein said switch is activated by fume temperatures of about 140° F.

RESULTS OF TESTS:

| | Furnace Without Smith Venting System | Furnace With Smith Venting System |
|---|---|---|
| Return Plenum Temperature, ° F | 76 | 76 |
| Supply Plenum Temperature, ° F | 138 | 148 |
| Air Flow through Furnace, cfm | 1708 | 1708 |
| Flue Gas Temperature, ° F | 302 | 187 |
| Flue Gas Volume, CFM | 159 | 136 |
| Flue Gas CO Content, % | N.D.* | N.D.* |
| Flue Gas $CO_2$ Content, % | 4.0 | 4.0 |
| Natural Gas Consumption Rate, cfh | 179.4 | 179.4 |
| Heat delivered to supply plenum, BTU/Hr. | 114540 | 133440 |

*N.D. = none detected. Limit of detection 100 parts per million

5. The invention of claim 3 and including means protecting said switch from cold air down drafts from the chimney flue that would neutralize the action thereof.

6. The invention of claim 1 wherein said diverter box is substantially rectangular and has a top wall, opposing end walls and opposing side walls and the open bottom, said top wall having a pair of openings adjacent the end walls and to which the first and second pipings are connected.

7. The invention of claim 6 wherein said top wall has upstanding collars surrounding the openings and to which said pipings are connected.

8. The invention of claim 6 wherein said first piping is a U-shaped pipe extending above the upper portion of the heating plant and the top wall of the diverter box and having vertical leg sections connected to the upper portion of the heating plant and the top wall of the diverter box.

9. The invention of claim 8 wherein a plate is vertically arranged transversely between the side walls to separate said sections at the bottom of the box and to protect said switch from cold air down drafts that would neutralize the action thereof.

10. The invention of claim 6 wherein said diverter box is divided into two end sections, one of which is communicated with the first piping and a safety limit switch housed in the wall for such section so as to be in communication with such section.

* * * * *